United States Patent [19]

Naum et al.

[11] 4,156,147

[45] May 22, 1979

[54] NEUTRON ABSORBING ARTICLE

[75] Inventors: Robert G. Naum, Lewiston; Dean P. Owens, Tonawanda; George I. Dooher, Niagara Falls, all of N.Y.

[73] Assignee: The Carborundum Company, Niagara Falls, N.Y.

[21] Appl. No.: 866,101

[22] Filed: Dec. 30, 1977

[51] Int. Cl.[2] ..... G21C 11/00

[52] U.S. Cl. ..... 250/518; 250/515

[58] Field of Search ..... 250/518, 515, 517; 252/478; 176/DIG. 2, 87

[56] References Cited

U.S. PATENT DOCUMENTS

| | | | |
|---|---|---|---|
| 2,727,996 | 12/1955 | Rockwell et al. | 250/517 |
| 3,106,535 | 10/1963 | Blanco | 250/518 |
| 3,231,521 | 1/1966 | Sturges et al. | 252/478 |
| 3,751,387 | 8/1973 | Hall et al. | 250/518 |

*Primary Examiner*—Bruce C. Anderson

*Attorney, Agent, or Firm*—David E. Dougherty; Robert C. Weber; Raymond F. Kramer

[57] ABSTRACT

A neutron absorbing article, preferably in flat plate form and suitable for use in a storage rack for spent nuclear fuel, includes boron carbide particles, diluent particles and a solid, irreversibly cured phenolic polymer cured to a continuous matrix binding the boron carbide and diluent particles. The total content of boron carbide and diluent particles is a major proportion of the article and the content of cured phenolic polymer present is a minor proportion. By regulation of the ratio of boron carbide particles to diluent particles, normally within the range of 1:9 and 9:1 and preferably within the range of 1:5 to 5:1, the neutron absorbing activity of the product may be controlled, which facilitates the manufacture of articles of particular absorbing activities best suitable for specific applications.

10 Claims, 4 Drawing Figures

NEUTRON ABSORBING ARTICLE

This invention relates to neutron absorbing articles. More particularly, it relates to such articles which comprise neutron absorbing boron carbide particles and diluent particles bound together in a matrix of cured phenolic polymer in a form suitable for absorbing neutrons from nuclear material, such as spent nuclear fuel.

It is well known that products of the radioactive decomposition of nuclear materials are harmful to human life and to the environment about such materials. Accordingly, where nuclear materials have been employed shielding has often been utilized so as to lower the level of radioactivity in surrounding areas.

Nuclear fuels employed in nuclear reactors to produce electric power diminish in activity to such an extent as they are consumed that periodic replacement is required to maintain reactor operations at specification rates. To increase the capacities of storage pools, such as have been employed in the past for temporary storage of such removed fuel and other nuclear wastes, the spent fuel has been stored in the pools in racks with neutron absorbing material surrounding it. Such racks and the storage of nuclear materials, such as spent fuel from nuclear power plants, in them have been described in U.S. patent application Ser. No. 854,966, filed Nov. 25, 1977, by McMurtry, Naum, Owens and Hortman, the disclosure of which is hereby incorporated by reference.

The McMurtry et al. application describes boron carbide-phenolic resin neutron absorbers which are preferably in long thin flat plate form and are of exceptionally high neutron absorbing capabilities because of their high contents of $B^{10}$ from the boron carbide particles therein. Although such products have met with acceptance by operators of nuclear power generating installations, in which they have been successfully employed, sometimes the greater neutron absorbing capabilities thereof are not required and on other occasions neutron absorption specifications may be lower than those for the McMurtry et al. neutron absorbers.

Because it is the $B^{10}$ in the boron carbide particles of the boron carbide-phenolic polymer compositions which is the active neutron absorber the absorption properties of boron carbide particles-phenolic polymer product may be lowered by diminishing the quantity of boron carbide therein and increasing the phenolic polymer content accordingly. Although such method allows the production of neutron absorbers of various activities by variations in the boron carbide:phenolic polymer ratio in the neutron absorbing articles made, the physical properties of the product as well as the neutron absorbing power thereof vary and accordingly, to meet specifications, it may often be necessary to make allowances for such variations in the design of the fuel storage racks or other environments wherein the nuclear material to be shielded is present. Such design variations often are not feasible. Additionally, different processing techniques will often have to be employed when the proportions of boron carbide and phenolic resin, from which the final cured polymer matrix is made, are changed. Thus, at high proportions of phenolic resin in the desired final product it may be necessary to utilize different and more expensive manufacturing techniques because, especially when liquid resin is utilized, the "green" article or plate first made from the boron carbide-phenolic resin mixture may not retain its desired form during the curing process unless it is held under a pressing or compacting pressure, which is not practical for the preferred simple oven cures of such articles. Because of the disadvantages accompanying properties changes due to variations in the ratio of boron carbide particles to phenolic resin in neutron absorbing articles containing such materials along and because of difficulties encountered in processes for the manufacture of such changed articles the present invention is especially advantageous. In accordance with this invention a neutron absorbing article comprises boron carbide particles, diluent particles and a solid, irreversibly cured phenolic polymer cured to a continuous matrix binding the boron carbide particles and the diluent particles. In such products usually the total content of the boron carbide particles and the diluent particles is a major proportion of the article and the content of the cured phenolic polymer is a minor proportion.

By means of the present invention neutron absorbing articles or plates can be made, utilizing mixtures of boron carbide particles and diluent particles with phenolic resin, the mixture of which can be pressed to green article form, and which articles can be subsequently cured efficiently and easily in an oven with a plurality of others. Because the diluent particles behave similarly to boron carbide particles, except for their lack of neutron absorbing capability, the manufacturing methods employed need not be changed and products of varying neutron absorbing powers may be manufactured, utilizing the same equipment and processes but changing the mixtures of boron carbide and diluent particles utilized. Also, the products made will have the desired physical and chemical characteristics for successful use as neutron absorbers in storage racks for installation in storage pools for spent nuclear fuel.

The invention will be readily understood by reference to the accompanying description thereof in the specification, taken in conjunction with the drawing in which.

Figure 1:
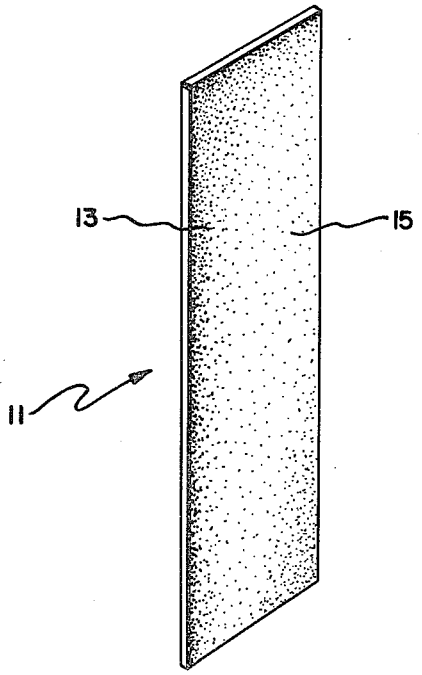
FIG. 1 is a perspective view of a neutron absorbing article of this invention, in plate form.

In FIG. 1 there is illustrated a typical neutron absorbing article, in the form of a long thin plate. For example, plate 19 may be of a length of about 93 cm., a width of about 22 cm. and a thickness of about 3 to 5 mm. The neutron absorbing plate 11 includes finely divided particles of boron carbide and diluent material in a matrix of cured and cross-linked phenolic polymer. Although the drawing illustrates particles 13 therein and shows areas 15 therebetween, separate boron carbide and diluent particles will not be identified because they are too closely intermixed and it should be realized that although area 15 may be taken as representative of the cured phenolic polymer, really there are no large areas of polymer or matrix alone because the particular materials are intimately blended in the polymer matrix. In the plate illustrated the presence of individual boron carbide and diluent particles is evident and such can be felt when the plates are handled although the particles are covered by cured polymer which binds them together, thereby helping to prevent accidental loss of particles during use and helping to maintain the neutron absorbing properties of the plates (or other articles) constant at design level. In use in a storage rack for spent nuclear fuels, the present "poison plates" may be stacked one above the other, to a total of about four or five plates, to a height of about 3.7 to 4.7 meters, for example. Usually such stacking will be within the walls of a stainless steel or other suitable enclosure to protect the plates from contact with the spent nuclear fuel or other nuclear material and from contact with an aqueous pool in which such material is being stored.

Figure 2:
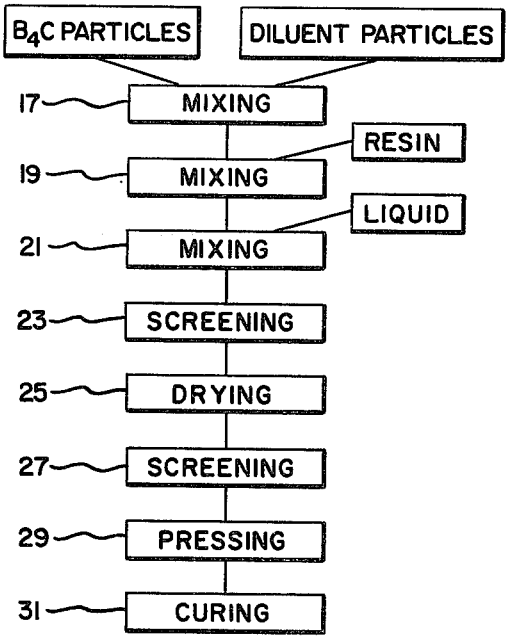
FIG. 2 is a diagrammatic representation of a preferred process for the manufacture of the neutron absorbing articles of this invention.

In the diagrammatic illustration of FIG. 2 there is shown a preferred method for the manufacture of the present neutron absorbers. Initially, weighed quantities of boron carbide and diluent particles are mixed together in operation 17 in a paddle mixer type of apparatus, following which resin particles are mixed with the premix, usually in the same mixer, in operation 19. After uniform blending of the mentioned components a predetermined proportion of liquid is mixed in with the previous dry mix in operation 21. After such mixing is completed and the liquid is well distributed throughout the product the mix is screened at 23 (to break up any lumps and to increase product uniformity) into drying trays to a desired thickness and in drying operation 25 is allowed to dry to a desired extent, preferably in a controlled environment, so that it is desirably "tacky" for molding, yet not too fluid so that it can distort objectionably during heating in the curing operation. Preferably the mentioned drying is effected at about room temperature, e.g., 10° to 35° C., preferably 20° to 25° C., and at normal relative humidities, e.g., 10 to 75%, preferably 35 to 65%, but other conditions can also be used to produce the same results. Next, the product is screened in operation(s) 27 and is added to a mold and pressed for a short period of time, which combined molding and pressing operation is designated 29. After pressing, the mold is unloaded and the pressed green article is cured, as represented by numeral 31 (preferably in a forced air oven), at an elevated temperature in a curing cycle which comparatively slowly increases the temperature to the desired elevated level, maintains it at such level and gradually lowers it to about room temperature. The products made are of desired density, uniformity of neutron absorbing capability, flexibility and other required and desired physical properties, look like that of FIG. 1 and are capable of being incorporated in any of various types of storage racks for spent nuclear fuel, such as are illustrated in FIG'S. 1 and 2 in U.S. patent application Ser. No. 854,966 of McMurtry et al., previously mentioned. The manufacturing method described above and illustrated diagrammatically in FIG. 2 is that of a co-pending patent application of Dean P. Owens, Ser. No. 866,102, entitled Method for Manufacture of Neutron Absorbing Articles, filed Dec. 30, 1977.

Figure 3:
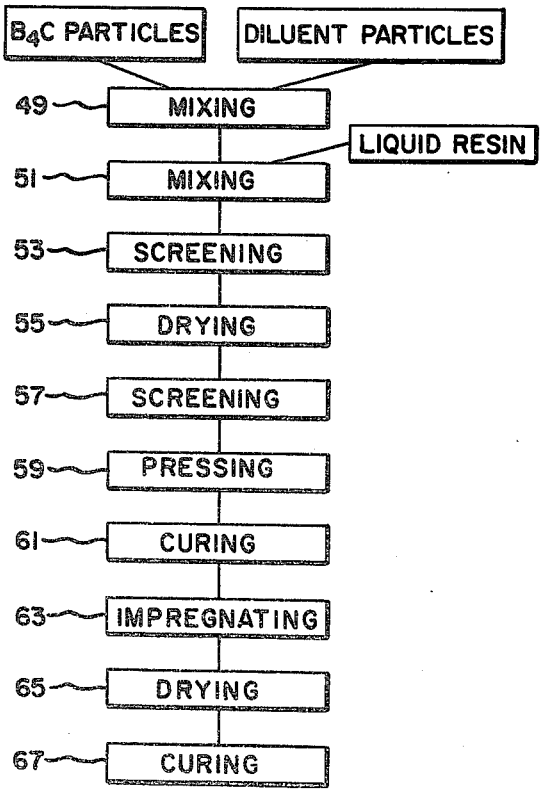
FIG. 3 is a diagrammatic representation of another method for the manufacture of the described articles.

Another method for the manufacture of the present articles is illustrated in FIG. 3 and corresponds substantially to that described in U.S. patent application Ser. No. 854,966 for Neutron Absorbing Article and Method for Manufacture of Such Article of McMurtry, Naum, Owens and Hortman, previously referred to in this specification and, with the mentioned Owens and Storm applications (see the following description of FIG. 4), hereby incorporated by reference. In such method, a two-stage curing process, the boron carbide particles and diluent particles are mixed at 49, after which liquid resin is mixed in with the premix at 51 until a substantially uniform blend is obtained, following which the blend is screened at 53, dried (55), screened again (57), molded and pressed (59), cured in operation 61, impregnated with additional liquid resin (63) and subsequently dried (65) and cured (67).

Figure 4:
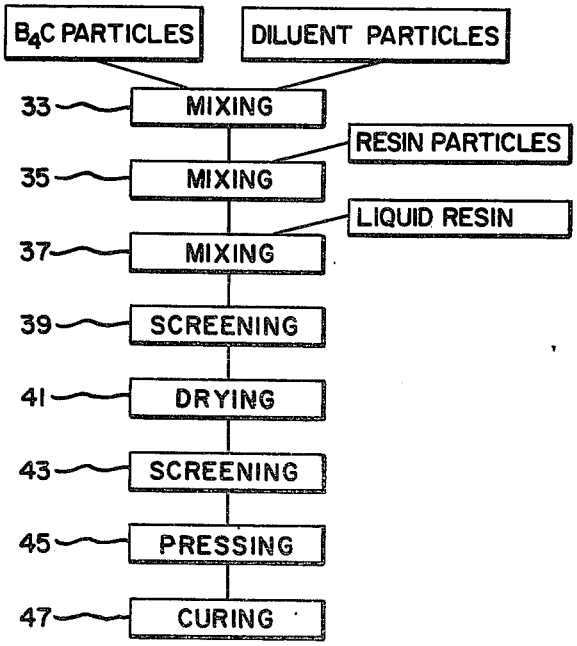
FIG. 4 is a diagrammatic representation of still another such manufacturing method.

In FIG. 4 there is shown an alternative method for the manufacture of the present absorber plates. Following such method, which is largely described in detail in U.S. patent application Ser. No. 856,378 of Roger S. Storm, for One-Step Curing Method for Manufacture of Neutron Absorbing Plates, filed Dec. 1, 1977, a mixture of boron carbide particles and diluent particles is mixed in operation 33, after which, usually in the same mixer, resin particles will be admixed therewith in operation 35, to be followed by addition of liquid resin and mixing 37, still in the original preferred paddle-type mixing apparatus. Subsequently the mix is screened, dried, screened, pressed and cured in operations identified by numerals 39, 41, 43, 45, 47, respectively, corresponding to those previously described and mentioned in the Storm applications.

The various methods described for the manufacture of the present articles all result in useful and commercially acceptable neutron absorbers but at the present time the order of preference is that of the numerical order of the representative figures, largely because of the improved efficiency, simplicity, lower breakage and shorter times attending the practice of the more preferred procedures. Of course, variations may be made in the described methods and in some cases additions, mixing procedures, screenings and dryings are varied in types, amounts and orders or are omitted in the interest of improving processing and the production of a more desirable product. For example, using the method of FIG. 2, when moisture content is reduced to the minimum or near the minimum to obtain a form-retaining green pressed item, preliminary drying before curing may be omitted.

Whether the present products are made by any of the foregoing methods or equivalently satisfactory processes, an important advantage of the neutron absorbing article of this invention is that it contains a high proportion of a total of boron carbide and diluent particles, with such proportion normally being more than half of the article. Also, by varying the proportion of diluent particles to boron carbide particles products of various neutron absorbing activities may be made without requiring changes in manufacturing techniques or in the apparatuses in which the absorbers are to be utilized. Such variations in neutron absorbing capabilities may be made without changing the thicknesses of the articles to be employed, which allows the use of a variety of absorbing articles of different absorption powers in the same type of holder or rack, as may be desired. Due to the uniformity of distribution of the boron carbide particles and diluent in the phenolic polymer matrix the neutron absorbing capabilities of the articles made may be controlled, enabling engineers to design storage racks to high degrees of precision, thereby allowing a wide range of planned effective loadings of storage racks for spent nuclear fuel when the present neutron absorbing articles are parts thereof.

The present absorbing articles are operable over temperature ranges at which the spent nuclear fuel is normally stored in storage racks. The articles withstand thermal cyclings from repeated spent fuel insertions and removals and withstand radiation from spent nuclear fuel over long periods of time without losing desirable neutron absorbing and physical properties. They are normally sufficiently chemically inert in water or in other aqueous media in which the spent fuel may be stored so as to retain effective neutron absorbing properties even when a leak occurs which allows the entry of such liquid into the enclosure for the neutron absorbing article in the storage rack and into contact with such article. The present plates do not galvanically corrode and are sufficiently flexible so as to withstand operational basis earthquake and safe shutdown seismic events without losing neutron absorbing capability and desirable physical properties when installed in a storage rack. Additionally, the high level of product consistency with any of a variety of design specifications for absorbing power, etc., provide a much needed technical validity for the present products.

The boron carbide employed should be in finely divided particulate form. This is important for several reasons, among which are the intimate mixing of such particles with finely divided diluent particles, preferably also in finely divided particulate form, the production of effective bonds to the phenolic polymer cured about the particles, the production of a continuous bonding of polymer with the boron carbide particles at the article surface and the obtaining of a uniformly distributed boron carbide content in the polymeric matrix. It has been found that the particle sizes of the boron carbide should be such that substantially all of it (over 95%, preferably over 99% and more preferably over 99.9%) or all passes through a No. 20 (more preferably No. 35) screen. Preferably, substantially all of such particles, at least 90%, more preferably at least 95%, passes through a No. 60 U.S. Sieve Series screen and at least 50% passes through a No. 120 screen. Although there is no essential lower limit on the particle sizes (effective diameters) usually it will be desirable from a processing viewpoint and to avoid objectionable dusting during manufacture for no more than 25% and preferably less than 15% of the particles to pass through No. 325 and/or No. 400 U.S. Sieve Series screens and normally no more than 50% thereof should pass through a No. 200 U.S. Sieve Series screen, preferably less than 40%.

Boron carbide often contains impurities, of which iron (including iron compounds) and $B_2O_3$ (or impurities which can readily decompose to $B_2O_3$ on heating) are among the more common. Both of such materials, especially $B_2O_3$, have been found to have deleterious effects on the present products and therefore contents thereof are desirably limited therein. For example, although as much as 3% of iron (metallic or salt) may be tolerable in the boron carbide particles of high boron carbide content absorbers, preferably the iron content is held to 2%, more preferably to 1% and most preferably is less than 0.5%. Similarly, to obtain stable absorbing articles, especially when they are of long, thin plate form, it is important to limit the $B_2O_3$ content (including boric acid, etc., as $B_2O_3$), usually to no more than 2%, preferably to less than 1%, more preferably to less than 0.5% and most preferably to less than 0.2%. Of course, the lower the iron and $B_2O_3$ contents the better.

The boron carbide particles utilized will usually contain the normal isotopic ratio of $B^{10}$ but may also contain more than such proportion to make even more effective neutron absorbers. Of course, it is also possible to use boron carbide with a lower than normal percentage of $B^{10}$ (the normal percentage being about 18.3%, weight basis, of the boron present) but such products are rarely encountered and are less advantageous with respect to neutron absorbing activities.

Other than the mentioned impurities, normally boron carbide should not contain significant amounts of components than than $B_4C$ (boron and carbon in ideal combination) and minor variants of such formula unless the $B_4C$ is intentionally diminished in concentration by use of a diluent or filler material, such as silicon carbide, as described herein. For satisfactory absorbing effectiveness at least 90% of the boron carbide particles should be boron carbide, preferably at least 94% and more preferably at least 97% and the $B^{10}$ content of the article (from the boron carbide) for best absorption characteristics, will be at least 12%, preferably at least 14% (14.3% $B^{10}$ in pure $B_4C$). To maintain the stability of the boron carbide-diluent-phenolic polymer article made it is considered to be important to severely limit the contents of halogen, mercury, lead and sulfur and compounds thereof, such as halides, in the final product and so of course, such materials, sometimes found present in impure phenolic resins, solvents, fillers and plasticizers, will be omitted from those and will also be omitted from the composition of the boron carbide particles to the extent this is feasible. At the most, such materials will contain no more of such impurities than would result in the final product just meeting the upper limits of contents allowed, which will be mentioned in more detail in a subsequent discussion with respect to the phenolic polymer and the resins from which it is made.

The diluent or filler materials employed in the present articles to diminish the neutron absorbing activities thereof will be such as are compatible with the other components of the present article, principally the boron carbide particles and the phenolic resin and will be able to withstand the conditions of use thereof. Thus, the "diluents" will usually be inert or essentially or substantially inert particulate solids which are insoluble in water and aqueous media to which the neutron absorbing articles might become exposed during use. Such materials should be heat resistant, substantially inert chemically and of comparatively low coefficients of thermal expansion. Generally, inorganic materials such as carbon and compounds, such as carbides and oxides, best satisfy these requirements and the most preferred diluents and fillers are silicon carbide, alumina, silica, graphite ad amorphous carbon although two-component and multi-component mixtures of such materials may also be utilized. Usually, the materials to be employed should be anhydrous, although they may contain small proportions, such as 0.5 to 3%, e.g., 1% e.g., 1%, of moisture, but hydrates may be utilized if the water content thereof is satisfactorily volatilized during curing of the phenolic polymer of the present articles at elevated temperature. Normally the diluents employed will be in particulate form and the powders thereof will be of particle size characteristics like those previously described for the boron carbide particles. It has been found that best flexural strength characteristics are obtained when the diluent particles are of the same particle sizes as the boron carbide particles. Finer particles cause a lessening of flexural strength although products resulting may pass specifications and it is believed that when the filler particles are too coarse similar strength diminutions will result. While such particle sizes are generally preferred, it is also within the invention to utilize more finely divided fillers, usually however providing that the particle sizes are not so small as to cause excessive dusting. Thus, while as much as 95% or more of the diluent particles may pass a 200 mesh sieve it will usually be preferred that no more than 50% of the particles, preferably less than 25% and more preferably, less than 15%, pass through a No. 325 sieve. With respect to impurities, as was previously mentioned, both the boron carbide particles and diluent particles should have low contents, if any at all, of $B_2O_3$, iron, halogen, mercury, lead and sulfur and compounds thereof. Although it is desirable that each component of the present composition have less of such impurities than the particular proportions given with respect to the boron carbide and the resin, it is considered that the important factor is the total content of such materials and providing that the total content is maintained within the specifications, variations in impurities contents of the components may be tolerated.

The solid irreversibly cured phenolic polymer, cured to a continuous matrix about the boron carbide and diluent particles and binding them together in the neutron absorbing articles, is preferably made from a phenolic resin which is in solid form at normal temperatures, e.g., room temperature, 20°-25° C. The phenolic resins constitute a class of well-known thermosetting resins, most and are condensation products of phenolic compounds and aldehydes. Of the phenolic compounds phenols and lower alkyl- and hydroxyl-lower alkyl-substituted phenols are preferred. Thus, the lower alkyl-substituted phenols may be of 1 to 3 substituents on the benzene ring, usually in ortho and/or para positions and will be of 1 to 3 carbon atoms, preferably methyl, and the hydroxy-lower alkyls present will similarly be 1 to 3 in number and of 1 to 3 carbon atoms each, preferably methylol. Mixed lower alkyls and hydroxy-lower alkyls may also be employed but the total of substitutent groups, not counting the phenolic hydroxyl, is preferably no more than 3. Although it is possible to make a useful product with the phenol of the phenol aldehyde resin being essentially all substituted phenol, some phenol may also be present with it, e.g., 5 to 50%. For ease of expression the terms "phenolic type resins", "phenol-aldehyde type resins" and "phenol-formaldehyde type resins" may be employed in this specification to denote more broadly then "phenol-formaldehyde resins" the acceptable types of matrials described which have properties equivalent to or similar to those of phenol-formaldehyde resins and trimethylol phenol formaldehyde resins when employed to produce thermosetting polymers in conjunction with boron carbide (plus diluent) particles, as described herein.

Specific examples of useful "phenols" which may be employed in the practice of this invention, other than phenol, include cresol, xylenol and mesitol and the hydroxylower alkyl compounds preferred include mono-, di- and trimethylol phenols, preferably with the substitution at the positions previously mentioned. Of course, ethyl and ethylol substitution instead of methyl and methylol substitution and mixed substitutions wherein the lower alkyls are both ethyl and methyl, the alkylols are both methylol and ethylol and wherein the alkyl and alkylol substituents are also mixed, are also useful. In short, with the guidance of this specification and the teaching herein that the presently preferred phenols are phenol and trimethylol phenol, other compounds, such as those previously described, may also be utilized providing that the effects obtained are similarly acceptable. This also applies to the selection of aldehydes and sources of aldehyde moieties employed but generally the only aldehyde utilized will be formaldehyde (compounds which decompose to produce formaldehyde may be substituted).

The phenolic or phenol formaldehyde type resins utilized are employed as either resols or novolaks. The former are generally called one-stage or single-stage resins and the latter are two-stage resins. The major difference is that the single-stage resins include sufficient aldehyde moieties in the partially polymerized lower molecular weight resin to completely cure the hydroxyls of the phenol to a cross-linked and thermoset polymer upon application of sufficient heat for a sufficient curing time. The two-stage resins or novolaks are initially partially polymerized to a lower molecular weight resin without sufficient aldehyde present for irreversible cross-linking so that a source of aldehyde, such as hexamethylenetetramine, has to be added to them in order for a complete cure to be obtained by subsequent heating. Either type of resin may be employed to make phenolic polymers such as those described herein. When the polymerization reaction in which the resin is formed is acid catalyzed HCl will be avoided (to minimize chloride content in the resin) and formic acid or other suitable chlorine-free acid may be used.

The solid state resin preferably employed is of a molecular weight sufficient to result in the resin being a solid, which will generally be in the range of 1,200 to 10,000, preferably 5,000 to 8,000 and more preferably 6,000 to 7,000, e.g., 6,500. The resin may have a small proportion of water present with it, which, if present, is usually adsorbed thereon and usually is less than 3% of the total resin or resin plus formaldehyde donor weight. If the resin is a resol it already contains sufficient formaldehyde for a complete cross-linking cure but if it is a novolak or two-stage resin it may have with it a formaldehyde donor such as hexamethylenetetramine, in sufficient quantity to cross-link the resin to irreversible polymerization (a thermoset). The quantity of cross-linking agent may vary but usually 0.02 to 0.2 part per part of resin will suffice. To avoid ammonia production during curing nitrogen-free formaldehyde donors may be employed, such as paraldehyde or a two-stage resin may be mixed with a one-stage resin containing excess combined or uncombined formaldehyde. Normally the particle sizes of the solid state two-stage or one-stage resins employed will be less than 140 mesh, U.S., Sieve series and preferably over 95% will be of particle sizes less than 200 mesh, to promote ready mixing with the boron carbide particles, even dispersion of the resin and such particles and good continuous resin cures.

Among the useful phenolic resin materials that may be employed in such particulate form that which is presently most preferred is Arofene-877, manufactured by Ashland Chemical Company, but other such resins, such as Arofenes 7214; 6745; 6753; 6781; 24780; 75678; 877LF; and 890LF; all made by Ashland Chemical Company, and PA-108 manufactured by Polymer Applications, Inc. and various other solid state phenolic resins, such as described at pages 478 and 479 of the 1975-1976 Modern Plastics Encyclopedia, the manufacturers of which resins are listed at page 777 thereof, may be substituted. Many of such resins are two-stage resins, with hexamethylenetetramine (HMT) incorporated but single stage solids may also be used, as may be two-stage resins with other aldehyde sources included and those dependent on addition of aldehyde. Although the mentioned resins are preferred, a variety of other equivalent phenolic type resins, especially phenolformaldehydes, of other manufacturers and of other types may also be employed providing that they satisfy the requirements for making the molded neutron absorbing articles set forth in this specification.

In the preferred method of manufacturing, described in FIG. 2, the liquid medium employed, the function of which is to assist in temporarily binding the powdered resin to the boron carbide and diluent particles, may be any of suitable liquids which can be volatilized off from the curing mixture at a temperature below the curing temperature. Because the curing temperature is normally below about 200° C. it is highly preferable that the liquid medium be of a material or materials which can be volatilized or boiled off at a temperature below 200° C. Most preferable of all such materials is water but aqueous solutions or even dispersions of other volatilizable, decomposable or reactant materials may also be employed. Thus, aqueous alcoholic liquids may be utilized, such as blends of water and ethanol, water and methanol, water and isopropanol. It may be desirable to employ aqueous solutions of formaldehyde or of hexamethylenetetramine, too. Additionally, phenol may be present in aqueous or aqueous alcoholic solution. Instead of using aqueous solution of alcohol the alcohols and other solvents may be utilized alone but generally this is not preferred because of expense, solvent recovery requirements and flammability hazards. When water is employed it will preferably be used alone or will be a major proportion of any mixed liquid, preferably being from 50 to 95% thereof, more preferably 70 to 95% thereof. Care should be taken to make sure that the water used is sufficiently pure (deionized or distilled water may be preferred) so as not to add any objectionable quantities of undesirable impurities to the final product.

The powdered resin described above is also useful in the practice of the process of FIG. 4 of the drawing. In such process liquid state phenolic resins are also employed and such liquid resins are also utilized in carrying out the process of FIG. 3. The liquid state resins or mixtures thereof employed in the practice of this invention are normally of the same types as the solid state particulate resins or mixtures thereof previously described but may also be of different types within the previous description. They are of low molecular weight, usually being the monomer, dimer or trimer. Generally the molecular weight of such resins will be in the range of 200 to 1,000, preferably 200 to 750 and most preferably 200 to 500. Such a resin will usually be employed as an aqueous, alcoholic, aqueous alcoholic or other solvent solution so as to facilitate "wetting" of the boron carbide and inert diluent particles and creation of a formable mass. Although water solutions are preferred, lower alkanolic solutions such as methanol, ethanol and isopropanol solutions or aqueous solvent(s) solutions or dispersions are also usable. Generally the resin content of the liquid state resin preparation employed will be from 50 to 90%, preferably about 55 to 85%. The solvent content, usually principally water, may be from 5 to 30%, usually being from 7 to 20%, e.g., 8%, 10%, 15%, with the balance of liquid components normally including aldehyde and phenolic compound. Thus, for example, in a liquid unmodified phenolic resin of the single-stage type based principally on the condensation product of trimethylolphenol and formaldehyde, there may be present about 82% of dimer, about 4% of monomer, about 2% of trimethylol phenol, about 4% of formaldehyde and about 8% of water. When two-stage resins are employed the curing agent may also be included with the resin, in sufficient quantity to completely or partially cure (cross-link) it. Such quantity (for a complete cure) can be 0.02 to 0.2 part per part of resin. To avoid ammonia production during curing a sufficient quantity of an aqueous solution of an aldehyde or another suitable source thereof which does not release ammonia may be used for curing novolaks instead of the usual hexamethylenetetramine. Also, excess formaldehyde which may be present with a one-stage resin may be utilized to help to cure a two-stage resin.

The liquid state resins employed are usually in liquid state because of the low molecular weight of the condensation products which are the main components thereof but also sometimes due to the presence of liquid media, such as water, other solvents and other liquids which may be present. Generally the viscosity of such resins at 25° C. will be in the range of 200 to 700 centipoises, preferably 200 to 500 centipoises. Usually the liquid state resin will have a comparatively high water tolerance, generally being from 200 to 2,000 or more percent and preferably will have a water tolerance of at least 300%, e.g., at least 1,000%. Among the useful liquid products that may be employed are Arotap 352-W-70; Arotap 352-W-71; Arotap 8082-Me-56; Arotap 8095-W-50; Arofene 744-W-55; Arofene 986-Al-50; Arofene 536-E-56; and Arofene 72155, all manufactured by Ashland Chemical Company; PA-149, manufactured by Polymer Applications, Inc.; and B-178; R3 and R3A, all manufactured by The Carborundum Company. All such resins will be modified when desirable (when contents of the following impurities are too high) to omit halides, especially chloride, halogens, mercury, lead and sulfur and compounds thereof or to reduce proportions thereof present to acceptable limits. In some cases the procedure for manufacture of the resin will be changed accordingly, for example, formic acid may be used as a polymerization catalyst instead of hydrochloric acid.

Different phenolic resins may be utilized for the solid particulate resins and liquid resins and mixtures may be employed in either case. However, very satisfactory products result when the particulate solid resin is a phenol formaldehyde polymer and the normally liquid state resin is a trimethylol phenol formaldehyde polymer.

Although various ratios of boron carbide particles to diluent particles may be employed in the making of the present neutron absorbing articles it is generally preferable that the weight ratio thereof be in the range of 1:19 to 19:1 and usually such range will be from 1:9 to 9:1. Because a neutron absorbing capability corresponding to more than 2% of $B^{10}$ is normally more desirable the ratio of boron carbide particles to diluent particles will usually be from 1:5 to 5:1, e.g., 1:2 to 2:1. Thus, while the $B^{10}$ content of the final product may be in the range of about 0.5 to 12% and is controllable over such range, it will preferably be at least 3%, e.g., 4 to 6%. Additional control of neutron absorbing power may be obtained by adjusting the dimensions of the article made, such as the thickness thereof, especially when the article is in flat plate form and is intended to be utilized as a wall about neutron emitting nuclear material.

Instead of utilizing only one type of diluent material with the boron carbide particles, various such inert, high temperature resistant, water insoluble products may be employed in mixture, often of about equal parts of such diluent particles in two- or multi-component mixtures, such as in ratios of 1:2 to 2:1 when two such diluents are employed and in ratios of about 1 to 2:1 to 2:1 to 2, when three components are present. Of course, more than three components may also be utilized.

The proportions of the total of boron carbide and diluent particles to irreversibly cured phenol formaldehyde type polymer in the neutron absorbing article will normally be about 60 to 80% of the former and 20 to 40% of the latter, preferably with the total about 100%. Preferably, the component proportions will be 65 to 80% and 20 to 35%, with the presently most preferred proportions being about 70% and 30% or 74% and 26% and with essentially no other components in the neutron absorber (the water or liquid medium is essentially all volatilized off during curing). Within the proportions described the product made has the desirable physical characteristics for use in storage racks for spent nuclear fuel, which characteristics will be detailed later. Also, the described ratios of the total of boron carbide and diluent particles to phenolic resin permit manufacture by the simple, inexpensive, yet effective method of this invention.

As was previously mentioned, various objectionable impurities will preferably be omitted from the present articles and the components thereof. Additionally, for most successful production of the present neutron absorbers, which should contain only very limited amounts, if any at all, of halogens, mercury, lead and sulfur, the content of $B_2O_3$, which may tend to interfere with curing, sometimes causing the "green" molded article to lose its shape during the cure, and which can have adverse effects on the finished article, and the content of iron will also preferably be limited. Generally, less than 0.1% of each of the mentioned impurities (except the $B_2O_3$ and iron) is in the final article, preferably less than 0.01% and most preferably less than 0.005%, and contents thereof in the resins are limited accordingly, e.g., to 0.4%, preferably 0.04%, etc. To assure the absence of such impurities the phenol and aldehyde employed will initially be free of them, at least to such an extent as to result in less than the limiting quantities recited, and the catalysts, tools and equipment used in the manufacture of the resins will be free of them, too. To obtain such desired results the tools and equipment will preferably be made of stainless steel or aluminum or similarly effective non-adulterating material but steel mixers have been found to be useful and not objectionably contaminating. Preferably impurities such as water, solvent, filler, plasticizer, halide or halogen, mercury, lead and sulfur should not be present or if any is present, the amount thereof will be limited as previously described and otherwise held to no more than 5% total in the final product. Generally, nonvolatile plasticizers and various other components sometimes employed with resins will be omitted.

To manufacture the present neutron absorbers by a preferred method the boron carbide particles, diluent particles and powdered resin are mixed together as previously mentioned, moisture is applied to the surface of such mix by suitable means so as to bring it into contact with all the particles, the moistened mix is compressed to green plate form and is then cured to final product. A useful method of manufacture is described in detail in the Owens application previously mentioned, and therefore little detail of such method will be given herein. Normally, dry mixing times will be from 1 minute to 20 minutes, preferably 2 to 10 minutes, after which moisture is mixed in and mixing is continued for about an equal period of time until the blend appears to be uniform. It may then be allowed to dry out somewhat, normally removing from ½ to ¾ of the mixture weight as moisture over a period of five minutes to one hour, and then is screened, if desirable, to remove any small lumps. The desired pre-calculated weight of boron carbide-diluent-resin mix next is screened into a clean mold cavity of desired shape through a screen of about 4 to 20 mesh on top of a bottom plunger, aluminum setter plate and glazed paper, glazed side to the mix, and is leveled in the mold cavity by sequentially running across the major surface thereof a plurality of graduated strikers. This gently compacts the material in the mold, while leveling it, thereby distributing the boron carbide and resin evenly throughout the mold so that when such mix is compressed it will be of uniform density and $B^{10}$ concentration throughout. A sheet of glazed paper is placed on top of the leveled charge, glazed side against the charge, and atop this there are placed a top setter plate and a top plunger, after which the mold is inserted in a hydraulic press and is pressed at a pressure of about 20 to 500 kg./sq. cm., preferably 35 to 150 kg./sq. cm., for a time of about 1 to 30 seconds, preferably 2 to 5 seconds. Plungers and plates on both sides of the pressed mixture, together with the pressed mixture, are removed from the mold together, the plungers and the setter plates are removed and the release papers are stripped from the pressed mixture. Fiberglass cloths are placed next to the molded item and then the green absorber plate and setter plate(s), usually of aluminium, are reassembled, with fiberglass cloth(s) between them. The assemblies are then inserted in a curing oven and the resin is cured. The cure may be effected with a plurality of sets of setter plates and green plates atop one another, usually three to ten, but curing may also be effected without such stacking, with only a lower setter plate being used for each green plate. Also, because the present mixes are not objectionably sticky, use of the fiberglass cloths may be omitted and in some cases use of the glazed paper may be omitted during pressing, at least for the portion of the mix in contact with the bottom setter plate, which supports the green plate during curing.

The cure may be carried out in a pressurized oven, sometimes called an autoclave, but good absorber plates may also be made without the use of pressure during the curing cycle. The curing temperature is usually between 130 and 200° C., preferably 140 to 160 or 180° C. and the curing usually takes from 2 to 20 hours, preferably 2 to 10 hours and most preferably 3 to 7 hours. For best results the oven will be warmed gradually to curing temperature, which facilitates the gradual evaporation of some liquid from the green articles before the curing temperature is reached, thereby helping to prevent excessive softening of the green plate and loss of shape thereof. A typical warming period is one wherein over about 1 to 5 hours, preferably 2 to 4 hours, the temperature is gradually increased from room temperature (10 to 35° C.) to curing temperature, e.g., 149° C., at which temperature the green plate is held for a curing period, and after which it is cooled to room temperature at a regular rate over about 1 to 6 hours, preferably 2 to 4 hours, after which the cured article may be removed from the oven. When the oven is pressurized the pressure may often be from about 2 to 30 kg./sq. cm., preferably 5 to 10 kg./sq. cm. gas pressure (not compressing or compacting pressure).

Instead of heating from room temperature to curing temperature in the allotted period described above, if it is considered desirable to improve the physical state of the green plate before curing it may be subjected to heating and drying in the oven at a temperature of about 40 to 60° C., e.g., 52° C., for about 6 to 48 hours, e.g., 24 hours, before such temperature is raised to curing level.

Instead of following the preferred procedure, alternative methods may also be utilized, such as are described in the Storm and McMurtry et al. patent applications, previously mentioned. Following the one-step processing of the Storm application the boron carbide and diluent particles are mixed, particulate resin powder is admixed with them and liquid resin is blended with the mix, after which, the molding, pressing and curing processes of the previously described process are followed, with screening, etc., as desirable. Normally the proportion of liquid state phenolic resin to solid state phenolic resin in the curable mixture thereof with the boron carbide and diluent particles is within the range of 1:0.5 to 1:4. Another method which may be employed for the manufacture of the present absorbing articles, that of the McMurtry et al. application, involves utilizing about 1/5 to $\frac{2}{3}$ preferably $\frac{1}{4}$ to $\frac{1}{2}$ of the resin, in liquid state, in initial mixture with all the boron carbide and diluent particles, pressing and curing a green plate of desired initial composition and then impregnating it with additional liquid resin, followed by curing.

The various methods described all result in the production of useful neutron absorbing articles, preferably in plate form, which have desirable characteristics for such a product. Although the neutron absorbing articles made in accordance with the invented process may be of various shapes, such as arcs, cylinders, tubes (including cylinders and tubes of rectangular cross-section), normally they are preferably made as comparatively thin, flat plates which may be long plates or which may be used a plurality at a time, preferably erected end to end, to obtain the neutron absorbing properties of a longer plate. To obtain adequately high neutron absorbing capability the articles will usually be from 0.2 to 1 cm. thick and plates thereof will have a width which is 10 to 100 times the thickness and a length which is 20 to 500 times such thickness. Preferably, the width will be from 30 to 80 times the thickness and the length will be from 100 to 400 times that thickness.

The neutron absorbing articles made in accordance with this invention are of a desirable density, normally within the range of about 1.2 g./cc. to about 2.8 g./cc., preferably 1.3 to 2 g./cc., e.g., 1.6 g./cc. They are of satisfactory resistance to degradation due to temperature and due to changes in temperature. They withstand radiation from spent nuclear fuel over exceptionally long periods of time without losing their desirable properties. They are designed to be sufficiently chemically inert in water so that a spent fuel storage rack in which they are utilized could continue to operate without untoward incident in the event that water leaked into their stainless steel container. They do not galvanically corrode with aluminum and stainless steel and are sufficiently flexible to withstand seismic events of the types previously mentioned. Thus, they are of a modulus of rupture (flexural) which is at least 100 kg./sq. cm. at room temperature, 38° C. and 149° C., a crush strength which is at least 750 kg./sq. cm. at 38° C. and 149° C., a modulus of elasticity which is less than $3\times10^5$ kg./sq. cm. at 38° C. and a coefficient of thermal expansion at 66° C. which is less than $1.5\times10^{-5}$ cm./cm. ° C.

The absorbing articles made, when employed in a storage rack for spent fuel, as in an arrangement like that shown at FIG'S. 1-3 of the McMurtry et al. patent application, previously mentioned, are designed to give the desired extent of absorption of slow moving neutrons, prevent active or runaway nuclear reactions and allow an increase in storage capacity of a conventional pool for spent fuel storage. The designed system is one wherein the aqueous medium of the pool is usually water at a slightly acidic or neutral pH or is an aqueous solution of a boron compound, such as an aqueous solution of boric acid or buffered boric acid, which is in contact with the spent fuel rods although such rods are maintained out of contact with the present boron carbide-diluent-phenolic polymer neutron absorber plates. In other words, although the spent fuel is submerged in a pool of water or suitable aqueous medium and although the neutron absorber plates are designed to surround it they are normally intended to be protected by a sealed metallic or similar enclosure from contact with both the pool medium and the spent fuel. Of course, the particular composition of the absorber plates will be regulated so that they will be resistant to chemical interaction with the storage pool.

The absorber plates made in accordance with this invention by the methods described above are subjected to stringent tests to make sure they possess the desired resistances to radiation, galvanic corrosion, temperature changes and physical shocks, as from seismic events. Because canisters or compartments in which they can be utilized might leak they also should be inert or substantially inert to long term exposure to storage pool water, which, for example, could have a pH in the range of about 4 to 6, a fluoride ion concentration of up to 0.1 p.p.m., a total suspended solids concentration of up to 1 p.p.m. and a boric acid content in the range of 0 to 2,000 p.p.m. of boron. Also, the "poison plates" of this invention should be capable of operation at normal pool temperatures, which may be about 27° to 93° C., and even in the event of a leak in the canister should be able to operate in such temperature range for relatively long periods of time, which could be up to six months or sometimes, a year. Further, the products should be able to withstand $1\times10^{11}$ rads and preferably, $2\times10^{11}$ rads total radiation, should not be galvanically corroded in use and should not cause such corrosion of metals or alloys employed. In this respect, while normally ordinary No's. 304 or 316 stainless steels may be used for structural members when seismic events are not contemplated, where such must be taken into consideration in the design of storage racks utilizing the present absorbers high strength stainless steels will preferably be used. The absorbers made may be of the lengths described in the McMurtry et al. application, e.g., 0.8 to 1.2 meters, so few joints are needed when plates are stacked one atop the other to form a continuous longer absorbing wall, or they may be made of other lengths. The desirable effects reported are obtainable using a variety of the phenolic resins described, alone or in combination, some of which may be one-stage and others of which may be two-stage, and a variety of the described diluents, either alone or in mixture, is also satisfactory. However, other resins and diluents outside the preferred class do not appear to have properties which allow the successful manufacture of stable and long lasting neutron absorbers by such simple methods and at reasonable costs.

The following examples illustrate but do not limit the invention. In the examples and in this specification all parts are by weight and all temperatures are in °C., unless otherwise indicated.

EXAMPLE 1

3,200 Grams of boron carbide powder and 4,080 grams of silicon carbide powder are mixed together in a steel paddle mixer at room temperature (25° C.) for five minutes and over another five minute period there are admixed therewith 2,450 grams of Ashland Chemical Company Arofene 877 powdered phenol formaldehyde resin. The boron carbide powder is one which has been previously washed with hot water and/or appropriate other solvents, e.g., methanol, ethanol, to reduce the boric oxide and any boric acid content thereof to less than 0.5% (actually 0.16%) of boric oxide and/or boric acid, as boric oxide. The powder analyzes 75.5% of boron and 97.5% of boron plus carbon (from the boron carbide) and the isotopic analysis of the boron present is 18.3 weight percent $B^{10}$ and 81.7% $B^{11}$. The boron carbide particles contain less than 2% of iron (actually 1.13%), and less than 0.05% each of halogen, mercury, lead and sulfur. The particle size distribution is 0% on a 35 mesh sieve, 0.4% on 60 mesh, 41.3% on 120 mesh and 58.3% through 120 mesh, with less than 15% through 325 mesh. The silicon carbide powder is a mixture of equal parts by weight of a silicon carbide powder which passes through a 50 mesh U.S. Sieve Series screen and fails to pass a 100 mesh sieve, and such a powder which passes a 100 mesh sieve. The more finely divided powder will usually have less than 25% thereof passing through a 325 mesh sieve. The contents of impurities in the silicon carbide particles will be maintained the same as or essentially the same as those of the boron carbide particles. The Arofene 877 powder (sometimes called 877 or PDW-877) is a two-stage phenolic resin powder of about 90% solids content (based on final cross-linked polymer) having an average molecular weight of 6,000 to 7,000 and a particle size distribution such that at least 98% passes through a 200 mesh sieve, and containing about 9% of hexamethylenetetramine (HMT). The resinous component is a condensation product of phenol and formaldehyde but instead of the phenol there may be substituted various other phenolic compounds, preferred among which is trimethylol phenol. The Arofene 877 resin may be characterized as an unmodified, short-flow, powdered, two-step phenolic resin. It exhibits an inclined plate flow of 25–40 mm., a reactivity (hot plate cure at 150° C.) of 60–90 seconds and a softening point (ring and ball, Dennis bar) of 80 to 95° C. and is of an apparent density of about 0.32 g./cc. It contains about 1% of volatile material. Instead of Arofene 877, in the present example there may be substituted Arofene 890 or Arofene 1877.

After mixing together of the powdered materials 300 grams of water are admixed with them by adding the water onto the moving surfaces of the mix, while it is being agitated in the paddle mixer. Spray nozzles may be employed to distribute the water better and in such cases the spray nozzle and the droplet sizes of the spray will be in the 0.5 to 2 mm. diameter range. However, it has been found that it is not required to spray the water or other liquid onto the surfaces of the particulate mixture and actually the water can be poured onto the moving surfaces or dripped onto them, with good mixing and distribution throughout the particulate material. After completion of mixing the mix may be screened through a 10 mesh (or 4 to 40 mesh) screen and may be allowed to stand for about an hour and then screened through a 10 mesh opening (or 4 to 40 mesh) screen, after which it may be filled into a mold, preferably after being leveled, and then pressed to green article shape, which shape is preferably that of a long thin flat plate, suitable for use in storage racks for spent nuclear fuel. Alternatively instead of screening, drying and screening, as described above, the screening may be done directly into the mold.

The mold employed comprises four sides of case hardened steel (brake die steel) pinned and tapped at all four corners to form an enclosure, identical top and bottom plungers about 2.5 cm. thick made of T-61 aluminum and 1.2 cm. thick top and bottom aluminum tool and jig setter plates, each weighing about one kg. The molds, which had been used previously, are prepared by cleaning of the inside surfaces thereof and insertions of the bottom plunger, the bottom setter plate on top of the plunger and a piece of glazed paper, glazed side up, on the setter plate. A charge (675 grams) of the boron carbide particles-silicon carbide particles-powdered resin-water mix fills the mold and is leveled in the mold cavity by means of a series of graduated strikers, the dimensions of which are such that they are capable of leveling from about a 12 mm. thickness to a desired 9 mm., with steps about every 0.8 mm. A special effort is made to make sure to fill the mold at the ends thereof so as to maintain uniformity of boron carbide (and silicon carbide) distribution throughout. Thus, the strikers are initially pushed toward the ends and then moved toward the more central parts of the molds and they are employed sequentially so that each strike further levels the mix in the mold. A piece of glazed paper is then placed on top of the leveled charge, glazed side down and the top setter plate and top plunger, both of aluminum, are inserted.

The mold is then placed in a hydraulic press and the powder-resin mix is pressed. The size of the "green" plate made is about 14.7 cm. by 77.2 cm. by 3.6 mm. and the density thereof is about 1.6 g./cc. The pressure employed is about 143 kg./sq. cm. and it is held for three seconds. The pressure may be varied so long as the desired initial "green" article thickness and density are obtained. After completion of pressing the mold is removed from the press and at an unloading station a ram and a fixture force the plungers, setter plates and pressed mixture upwardly and through the mold cavity. The plungers, setter plates and glazed papers are then removed and the pressed mixture, in green article form, is placed between setter plates and intermediate layers of fiberglass cloth and is cured. Curing is effected by heating from room temperature to 149° C. gradually and regularly over a period of three hours, holding at 149° C. for four hours and cooling to room temperature at a uniform rate for three hours. After curing, the plate weighs 640 grams and its dimensions are essentially the same as after being pressed to green plate form.

The finished plate is of about 72% of a total of boron carbide and diluent particles (31.6% of boron carbide and 40.4% of silicon carbide) and 28% of phenolic polymer. It appears to have the same desirable properties (except for lower neutron absorbing capability) of a similar product in which the silicon carbide particles are replaced by boron carbide particles. Thus, when tested it will be found to have a modulus of rupture (flexural) of at least 100 kg./sq. cm. at room temperature, 38° C. and 149° C. (actually 496 kg./sq. cm. at room temperature), a crush strength of at least 750 kg./sq. cm. at 38° C. and 149° C., a modulus of elasticity less than $3\times10^5$ kg./sq. cm. at 38° C. (actually $1.2\times10^5$ kg./sq. cm. at room temperature) and a coefficient of thermal expansion at 66° C. which is less than $1.5\times10^{-5}$ cm./cm.° C. The neutron absorbing plates made will be of satisfactory resistance to degradation due to temperature and changes in temperature such as may be encountered in normal uses as neutron absorbers, as in fuel racks for spent nuclear fuels. They are designed to withstand radiation from spent nuclear fuel over long periods of time without losing desirable properties and similarly are designed to be sufficiently chemically inert in water so that a spent fuel storage rack could continue to operate without untoward incident in the event that water should leak into a stainless steel or other suitable metal or other container in which they are contained in such a rack. They do not galvanically corrode and are sufficiently flexible, when installed in a spent nuclear fuel rack, to survive seismic events of the types previously mentioned. In other words, they will be of essentially the same properties as the neutron absorbing plates described in the Owens patent application previously referred except that they are of a lesser neutron absorbing capability due to being diluted with the silicon carbide particles.

When the experiment of Example 1 is repeated, with the silicon carbide being replaced by amorphous carbon, graphite, alumina or silica of essentially the same particle sizes and distributions or with equal mixtures of diluent components in 2-component or multi-component mixtures, e.g., amorphous carbon and graphite, amorphous carbon and silicon carbide, or amorphous carbon, graphite and silicon carbide, the same type of useful neutron absorber may be made. Also, when component proportions are varied, ±10%, ±20%, and ±30%, while being maintained within the ranges given in the foregoing specification, useful neutron absorbers may be made while varying the processing conditions, as taught above. Thus, neutron absorbers of any of a desired range of activities may be readily produced.

EXAMPLE 2

A neutron absorber of essentially the same neutron absorbing and stability characteristics as that described in Example 1 is made by mixing together the same quantities of the same boron carbide and silicon carbide particles in the same manner but instead of mixing dry resin and water with them a lesser quantity, 750 grams, of liquid state phenolformaldehyde type resin (primarily trimethylol phenol formaldehyde) is utilized. The resin employed is Ashland Chemical Company Arotap Resin 358-W-70 and it is mixed with the mixture of boron carbide and silicon carbide powder for 30 minutes to produce a homogeneous mixture in which the resin appears to be substantially uniformly distributed over the surfaces of the particles. The Arotap resin solution employed, a thick liquid, having a viscosity of 200 to 500 centipoises at 25° C. and a water tolerance of about 1,000%, is principally a condensation product of trimethylolphenol and formaldehyde and contains about 82% of dimer, about 4% of monomer, about 2% of trimethylolphenol, about 4% of formaldehyde and about 8% of water. The resin contains less than 0.01% of each of halogen, mercury, lead and sulfur, including compounds thereof.

After completion of mixing, which is effected in a suitable stainless steel or aluminum paddle mixer, the mix is screened through a 3 mesh sieve and is allowed to dry for 16 hours at room temperature (15° to 30° C.) and normal humidity (35 to 65% R.H.). The loss in weight is about 55 to 70% of the volatiles and moisture content or about 6% of the weight of the resin, which corresponds to about 0.6% of the weight of the total mixture. The mix is next screened through a ten mesh screen and is ready for use.

The molds employed are those previously described, as is the pressing method. The size of the green plate made is about 14.7 cm. by 77.2 cm. by 2.8 mm. and the density is about 1.7 g./cc. After completion of pressing and removal of release paper from the molded article the green plate, resting on the bottom setter plate, is placed flat in an oven, with the major surface thereof facing upwardly and the initial cure thereof is commenced. This is effected by increasing the temperature gradually by about 40° C. per hour from room temperature to 149° C. over a period of about three hours, holding for four hours at 149° C. and then cooling at a rate of about 40° C./hr. for three hours, back to room temperature. The total cycle is about ten hours and is automatically controlled. At the end of the curing cycle (the initial cure) the pressed plate can be easily removed from the setter plate and is independently form retaining. When weighed it is noted that it has lost additional weight, often losing an average of about 20 grams, so that it weighs about 510 grams. The density of the plate is about 1.6 g./cc.

After completion of the initial cure the pressed plate, removed from the setter plate, is positioned vertically in a basket with various other such plates, standing on ends therein and separated by wires or screening and the basket is inserted into an impregnating vessel, which includes connections to sources of vacuum, pressurized air and liquid resin. The stainless steel vessel is then sealed and a vacuum of about 660 mm. of mercury is drawn on the tank over a period of about five minutes, after which the valve to the resin supply is opened and liquid resin (Arotap 358-W-70) is drawn into the tank and is allowed to completely cover all of the plates therein. Such addition of resin takes place over a period of about 1 to 5 minutes, after which the connection to the vacuum source is closed and the plates, submerged in the liquid resin, are allowed to absorb such resin over a period of 1 to 5 minutes. Then the resin is forced from the tank by compressed air at a pressure of about 260 mm. Hg gauge. The vessel is then opened and the basket containing the impregnated plates is removed therefrom. The plates are taken out of the baskets, are placed on their thin sides on drying racks separated by lengths of stainless steel or aluminum wire or clips and are dried at 52° C. for a period of about 60 hours. During this drying operation there is a weight loss of about 1/12 of the approximately thirty additional percent of liquid state phenolic resin impregnating the plates (about 1.9% of the weight of the plates). The resin add-on is about 3/5 to 3/4 of the total resin content.

The dried impregnated plates are next placed on setter plates of the type previously described, form-retaining flat aluminum, with fiberglass cloth separators covering the impregnated plates, and are stacked six high, flat sides up and down, on carts, which are then placed in a pressurizable oven, which is sealed and pressurized to about 6.4 kg./sq. cm. gauge. The temperature in the pressurized oven is raised to 149° C. gradually over a seven hour period with one hour holds at 79° C., 93° C. and 121° C. After holding for four hours at 149° C. the temperature is gradually decreased to room temperature over a period of five hours, dropping at about 26° C. per hour. Thus, the total pressurized curing cycle takes sixteen hours, after which the cured plates are removed from the carts and are inspected. They weigh 637 grams.

The finished plates are of about the same composition as those of Example 1 and of about such dimensions and density. On testing they will be found to have a modulus of rupture (flexural) of at least 100 kg./sq. cm. at 25° C., 38° C. and 149° C. (actually 350 kg./sq. cm. at room temperature), a crush strength of at least 750 kg./sq. cm. at 38° C. and 149° C., a modulus of elasticity of less than $3\times10^5$ kg./sq. cm. at 38° C. (actually $1.5\times10^5$ kg./sq. cm. at room temperature) and a coefficient of thermal expansion at 66° C. which is less than $1.5\times10^{-5}$ cm./cm.° C. Like the products of Example 1, they are useful poison plates for absorption of neutrons from radioactive materials, especially spent nuclear fuel in rack storage in aqueous pools. They will be capable of resisting seismic conditions, as previously described, temperature and temperature changes experienced in spent fuel storage racks and other stresses and strains normally placed on them in such applications.

The above experiment is repeated for verification of the reproducibility of the results and the modulus of rupture and modulus of elasticity of the products resulting are measured. The modulus of rupture is found to be 321 kg./sq. cm. at room temperature and the modulus of elasticity is measured as $1.5\times10^5$ kg./sq. cm. at room temperature. The product appears to be of the same desirable physical and chemical characteristics as that described above in this example.

When the composition of the plates is changed, as in Example 1, preferably when amorphous carbon or graphite is substituted for a silicon carbide or is employed in conjunction with it, and when the shapes thereof are changed, such as to curved shapes, as described previously in the specification, interchangeably useful products of predictable and controllable neutron absorbing capabilities may be made.

EXAMPLE 3

When the procedures of Examples 1 and 2 are varied, as described in the Storm patent application previously referred to, similarly useful articles are producible. Such are made when instead of boron carbide particles being utilized, 44:56 mixtures of boron carbide and silicon carbide are utilized in the processes of the Storm working examples. Also, similarly useful products are producible when instead of silicon carbide, amorphous carbon, graphite, alumina and silica or a mixture thereof is utilized and when the proportions of boron carbide to inert diluent particles are varied, as previously mentioned.

In practicing the invention as described in the foregoing specification and as is illustrated in the working examples, components of the products will be chosen so as to result in the production of satisfactory products, of sufficient neutron absorbing capability to be useful, of controllable neutron absorbing capabilities and of properties resistant to the environment in which they are intended to be employed. Thus, for example, diluents and other components utilized will be resistant to elevated temperature, rapid temperature changes and to extended radiation exposure. Similarly, with respect to workability and processing characteristics, the components will be chosen so as to facilitate mixing, blending, maintenance of structural integrity after pressing into green plate form and maintenance of such form during curing. One of skill in the art with this specification before him will be able to select particular components and processing conditions, such as temperatures, humidities, pressures and times, so as to able to manufacture the desired products quickly, efficiently and satisfactorily.

The invention has been described with respect to various illustrations and embodiments thereof but is not to be limited to these because it is evident that one of skill in the art with the present specification before him will be able to utilize substitutes and equivalents without departing from the spirit of the invention.

What is claimed is:

1. A neutron absorbing article which comprises boron carbide particles, diluent particles and a solid, irreversibly cured phenolic polymer cured to a continuous matrix binding the boron carbide particles and the diluent particles, in which the total content of the boron carbide particles and the diluent particles is a major proportion of the article and the content of the cured phenolic polymer is a minor proportion.

2. A neutron absorbing article according to claim 1, suitable for use in storage racks for spent nuclear fuel, which is operable over a temperature range at which the spent nuclear fuel is stored, withstands thermal cycling from repeated spent fuel insertions and removals and withstands radiation from said spent nuclear fuel for long periods of time without losing desirable neutron absorbing and physical properties, is sufficiently chemically inert in water so as to retain neutron absorbing properties in the event of a leak allowing the entry of water into an enclosure for the neutron absorbing article in a storage rack for spent nuclear fuel and into contact with it, does not galvanically corrode and is sufficiently flexible so as to withstand operational basis earthquake and safe shutdown earthquake seismic events without loss of neutron absorbing capability and other desirable physical properties when installed in such storage rack, in which the diluent is selected from the group consisting of silicon carbide, graphite, amorphous carbon, alumina and silica and mixtures of any or all thereof, the phenolic polymer is of a phenol formaldehyde type resin, the total of boron carbide and diluent particles contains no more than 2% of $B_2O_3$, the neutron absorbing article contains about 60 to 80% of a total of boron carbide particles and diluent particles and about 20 to 40% of irreversibly cured phenol formaldehyde type polymer and the ratio of boron carbide particles to diluent particles is in the range of 1:9 to 9:1.

3. A neutron absorbing article according to claim 2, in plate form, wherein the total of boron carbide and diluent particle content is from 60 to 80%, the phenol formaldehyde type polymer content is from 20 to 40%, the phenol formaldehyde type polymer continuously covers the boron carbide and diluent particles and the density of the plate is from 1.2 g./cc. to about 2.8 g./cc.

4. A neutron absorbing plate according to claim 3 wherein the ratio of boron carbide particles to diluent particles is in the range of 1:5 to 5:1, the density of the plate is from 1.6 to 2.5 g./cc., the thickness is from 0.2 to 1 cm., the width is from 10 to 100 times the thickness and the length is from 20 to 500 times the thickness, the modulus of rupture (flexural) is at least 100 kg./sq. cm. at room temperature, 38° C. and 149° C., the crush strength is at least 750 kg./sq. cm. at 38° C. and 149° C., the modulus of elasticity is less than $3\times10^5$ kg./sq. cm.

at 38° C., and the coefficient of thermal expansion at 66° C. is less than $1.5\times10^{-5}$ cm./cm.° C.

5. A neutron absorbing plate according to claim 4 wherein the phenol formaldehyde type polymer is substantially free of halogen, mercury, lead and sulfur and the total of the boron carbide and diluent particles contains no more than 1% of $B_2O_3$ and 2% of iron.

6. A neutron absorbing plate according to claim 5 wherein the boron carbide and diluent particles are of particle sizes such that at least 95% thereof passes through a No. 60 U.S. Sieve Series screen and at least 50% thereof passes through a No. 120 U.S. Sieve Series screen, the total boron carbide particles and diluent particles content of the plate is from 65 to 80% and the phenol formaldehyde type polymer content is from 20 to 35%.

7. A neutron absorbing plate according to claim 1 wherein the diluent particles are silicon carbide particles.

8. A neutron absorbing plate according to claim 6 wherein the diluent particles are silicon carbide particles.

9. A neutron absorbing plate according to claim 8 substantially free of plasticizer, solvent and filler, other than the diluent particles.

10. A neutron absorbing plate according to claim 9 consisting essentially of the described boron carbide and silicon carbide particles and phenol formaldehyde polymer.

* * * * *